US008468856B2

(12) United States Patent
Fukui

(10) Patent No.: US 8,468,856 B2
(45) Date of Patent: Jun. 25, 2013

(54) TUBULAR KNITTED FABRIC FOR CLOTHING AND LEGWEAR

(75) Inventor: Takao Fukui, Nara (JP)

(73) Assignee: Okamoto Corporation, Nara (JP)

( * ) Notice: Subject to any disclaimer, the term of this patent is extended or adjusted under 35 U.S.C. 154(b) by 0 days.

(21) Appl. No.: 13/193,748

(22) Filed: Jul. 29, 2011

(65) Prior Publication Data

US 2012/0024014 A1 Feb. 2, 2012

(30) Foreign Application Priority Data

Jul. 30, 2010 (JP) ..... P2010-173096

(51) Int. Cl.
*D04B 11/28* (2006.01)

(52) U.S. Cl.
USPC ..... 66/178 R

(58) Field of Classification Search
USPC ..... 66/177, 176, 178 R, 170, 171
See application file for complete search history.

(56) References Cited

U.S. PATENT DOCUMENTS

| | | | | |
|---|---|---|---|---|
| 1,877,458 A | | 9/1932 | Harris | |
| 2,337,153 A | | 12/1943 | Cloutier | |
| 2,921,454 A | | 1/1960 | Shastany | |
| 4,341,095 A | * | 7/1982 | Poteat | 66/177 |
| 5,590,548 A | * | 1/1997 | Osborne | 66/177 |
| 5,787,732 A | * | 8/1998 | Perron et al. | 66/177 |
| 5,991,929 A | * | 11/1999 | Imboden et al. | 2/409 |
| 6,055,674 A | * | 5/2000 | Imboden et al. | 2/409 |
| 6,412,311 B1 | | 7/2002 | Nakai | |
| 7,155,940 B1 | * | 1/2007 | Imboden et al. | 66/8 |
| 8,156,768 B2 | * | 4/2012 | Green et al. | 66/187 |

FOREIGN PATENT DOCUMENTS

| | | |
|---|---|---|
| EP | 1203837 | 5/2002 |
| GB | 2155965 | 10/1985 |
| JP | 9-195104 | 7/1997 |
| JP | 2002-302853 | 10/2002 |
| JP | 2004-316000 | 11/2004 |

OTHER PUBLICATIONS

Search report from E.P.O., mail date Jan. 3, 2012.

* cited by examiner

*Primary Examiner* — Danny Worrell
(74) *Attorney, Agent, or Firm* — Greenblum & Bernstein P.L.C.

(57) ABSTRACT

A tubular knitted fabric for clothing has a first stitch and a second stitch smaller than the first stitch. The pattern of the tubular knitted fabric for clothing is obtained by selectively disposing the second stitch in units of one stitch. Selectively driving a sinker of a circular knitting machine controls stitch densities, thereby producing the first stitch and the second stitch smaller than the first stitch. A legwear is formed of this tubular knitted fabric for clothing.

3 Claims, 6 Drawing Sheets

(A)

(B)

TUBULAR KNITTED FABRIC FOR CLOTHING AND LEGWEAR

BACKGROUND OF THE INVENTION

1. Field of the Invention

The present invention relates to a tubular knitted fabric for clothing and legwear having a plurality of stitches knitted to obtain desired patterns by a circular knitting machine.

2. Related Background Art

The preferences of individuals have been diversified in recent years as the information and technologies have grown more diverse. Highly fashionable garments are required as one of the ways to express one's individuality. One of the important requirements to provide a highly fashionable knit garment is to represent (obtain) the appearance of the knit garment, such as the delicate and beautiful patterns on the surface of the knit garment, as well as the entire shape of the knit garment.

Examples of conventional methods for representing a pattern of a knit garment include a method using cut-boss (color in color) patterns ("a method for selectively inserting a yarn (pattern yarn) different than a knitting yarn"), a method using mesh knitting or tuck knitting (a method using a change in a knitted structure), and a method for representing patterns by means of embroidery.

However, the problems involved in "a method for selectively inserting a yarn (pattern yarn) different than a knitting yarn" are such that an end of a cut pattern region becomes exposed on the surface, detracting from the appearance or quality of the knit garment and making the knit garment uncomfortable to wear, that the raw materials of the cut end becomes a waste, inhibiting the conservation of the natural resources, reducing the production efficiency and increasing the costs, that yarns that are not used for stitching inhibit the horizontal stretching linearly over the course directions on the rear surface of the fabric, and that no patterns can be inserted in a region knitted by a reciprocal rotation.

A problem involved in "a method using a change in a knitted structure" is such that it is difficult to produce a product conforming with a purpose due to the direct impact of the knitted structure on the thickness of the fabric (a mesh stitch part is thin but a tuck stitch part is thick). Because at least two courses are required in order to construct at least one of such a knitted structure, delicate patterns cannot be represented.

Problems in embroidery are such that an embroidered part cannot stretch, providing a wearer with excessive tightness, that the embroidered part is hard and hence provides irritates the wearer's skin when contacting the skin, and that the high yarn cost and the large number of knitting steps increase the costs.

In addition to the above-described method for representing a pattern, there is a method for representing a pattern by using the shading of the knitted fabric that is generated by controlling the size of a stitch (stitch density) (see Japanese Patent Application Publication No. 9-195104, Japanese Patent Application Publication No. 2002-302853, for example). Japanese Patent Application Publication No. 9-195104 discloses "a method using the activation of a stitch cam," and Japanese Patent Application Publication No. 2002-302853 discloses a method "for changing a feeding tension applied to a knitting yarn."

In the pantyhose disclosed in Japanese Patent Application Publication No. 9-195104, stitch parts that have at least two different stitch lengths in the same course are formed in at least a part of a foot part in order to provide a contact pressure difference in a weft direction, and the stitch parts with different stitch lengths form a pattern. This pantyhose is produced by using a circular knitting machine that has a device capable of changing the stitch lengths in the same course by moving a knitting cam vertically.

The patterned knitted fabric disclosed in Japanese Patent Application Publication No. 2002-302853 has a pattern that is configured by parts with different loop lengths that are obtained by changing a feeding tension applied to a knitting yarn fed from a yarn guide to a knitting needle.

The effects obtained by controlling the sizes of stitches include the ones described in Japanese Patent Application Publication No. 2004-316000.

In the stitch knitting method disclosed in Japanese Patent Application Publication No. 2004-316000, a circular knitting machine forms large stitches and small stitches in a knitting texture of the same course without changing how much a knitting needle is pulled in by a stitch cam.

However, according to the technology described in Japanese Patent Application Publication No. 9-195104 ("a method using the activation of a stitch cam"), the activation of the stitch cam cannot be applied accurately in units of one stitch (one needle). For this reason, the stitch density cannot be controlled precisely in units of one stitch. As a result, vivid (detailed) patterns cannot be formed. In addition, because a region knitted by a reciprocal rotary movement cannot control the stitch density, a pattern obtained by controlling the stitch density cannot be inserted into the region, limiting the fashion of the pantyhose.

Because the technology described in Japanese Patent Application Publication No. 2002-302853 ("a method for changing a feeding tension applied to a knitting yarn") focuses primarily on representing a gradational pattern by gradually changing the stitch density, the clear shading of the knitted fabric cannot be obtained in units of one stitch, and consequently a complicated pattern cannot be represented vividly.

The main purpose of the technology described in Japanese Patent Application Publication No. 2004-316000 is to prevent a pattern yarn from being removed (prevent it from being exposed on the surface), by reducing the sizes of the stitches in the end part having a cut-boss pattern (the beginning/ending of the pattern in each course). However, this technology does not take into consideration how to obtain the pattern by controlling the stitch density.

SUMMARY OF THE INVENTION

The present invention was contrived in view of the problems described above, and an object thereof is to provide a highly fashionable tubular knitted fabric for clothing that is capable of obtaining a detailed pattern on a surface of a knit garment and is comfortable to wear. An additional object of the present invention is to provide a tubular knitted fabric for clothing capable of obtaining vivid shadings of adjacent stitches and achieving a beautiful knitted pattern.

A tubular knitted fabric for clothing according to the present invention is a tubular knitted fabric that is knitted to obtain a desired pattern by a circular knitting machine capable of moving a sinker in and out between reciprocating knitting needles to knit stitches of a plurality of sizes in a same course, wherein the stitches of the plurality of sizes include a first stitch and a second stitch smaller than the first stitch, the pattern is obtained by selectively disposing the second stitch in units of one stitch, and the second stitch is formed by selectively driving the sinker to move in and out between the knitting needles.

According to stitch density control performed by selectively driving the sinker, the stitch density corresponds to a distance between "a contact point between a knitting yarn and the sinker" and "a contact point between the knitting yarn and the knitting needles." Therefore, the contact point between the knitting yarn and the sinker, which is the position on the sinker on which the knitting yarn is placed, can be selected based on a forward movement/backward movement of the sinker, so that the stitch density can be selectively disposed in a desired position in units of one stitch. In addition, this selection is not constrained even during the reciprocal rotary movement of the needles.

A part where the second stitch having a smaller stitch density than the first stitch is disposed is tight and therefore appears to have thick colors. For this reason, the pattern can be obtained using the shading of the colors by arbitrarily disposing the first and second stitches.

According to the tubular knitted fabric for clothing of the present invention, the stitch density can be associated with the distance between "the contact point between the knitting yarn and the sinker" and "the contact point between the knitting yarn and the knitting needles." Therefore, the first stitch with a great stitch density and the second stitch with a small stitch density can be arranged accurately, thereby vividly obtaining a complicated pattern. In other words, a part in which the first stitch and the second stitch are arranged adjacent to each other vividly shows the shading of the adjacent stitches. As a result, a highly fashionable knit garment can be realized.

In addition, since the circular knitting machine can continuously knit the entire tubular knitted fabric for clothing, the pattern can be represented using only the knitting yarn for knitting a body (fabric main body) outside the pattern. Therefore, the pattern can be foamed only by a normal sock knitting step. This results in an improvement in the production efficiency, cost reduction, and a favorable tubular knitted fabric for clothing.

Moreover, a pattern yarn is not required because the pattern can be obtained using a method for controlling the stitch density. This can prevent an increase in costs. Furthermore, since the discharge of the cut end yarn is prevented, wastes and environmental burden can be reduced. Because there is very little change in thickness of the knitted fabric like a fabric obtained by mesh knitting and tuck knitting, the tubular knitted fabric for clothing can be applied widely regardless of the seasons or applications. In addition, the tubular knitted fabric for clothing does not provide a feeling of a foreign body produced by a pattern yarn. Therefore, the tubular knitted fabric for clothing can be worn comfortably and smoothly as with a knitted fabric without patterns.

It is preferred that the tubular knitted fabric for clothing have a positive rotation region that is formed by knitting by a positive rotation of a cylinder of the circular knitting machine, and a reciprocal rotation region that is formed by knitting by a reciprocal rotation of the cylinder, and that the pattern be obtained continuously astride the positive rotation region and the reciprocal rotation region.

Note that the term "cylinder" means a tubular part of the circular knitting machine for storing the knitting needles. When this cylinder rotates around a vertical central line, the knitting needles move vertically to knit a knitted fabric. The knitted fabric formed by the circular knitting machine has a tubular shape. In the present application, a loop knitted by the knitting yarn is called "stitch" and the size of the stitch is called "stitch density."

The term "positive rotation" means the counterclockwise rotation (left hand turn) of the cylinder and "negative rotation" means the clockwise rotation (right hand turn) of the cylinder, when viewing the knitting machine from above. The term "reciprocal rotation" means a movement where the cylinder repeats a halfway positive rotation and halfway negative rotation. In the tubular knitted fabric, a part knitted by the reciprocal rotation of the cylinder corresponds to, for example, a heel or a toe.

According to the tubular knitted fabric for clothing described above, for example, a complicated pattern can be continuously formed vividly from a part adjacent to the heel or toe of a sock to the heel or toe. As a result, a new, highly fashionable tubular knitted fabric for clothing can be realized.

In order to gain a high level of fashionability, it is important that the pattern be visually perceived from any directions, i.e., from the front or back, or from the left or right. In the tubular knitted fabric for clothing of the present invention, preferably, within one course or two or more continuous courses of the tubular knitted fabric for clothing, at least four small stitch bands each having one or two or more of the second stitches are formed. Accordingly, a visually high level of fashion can be realized.

The tubular knitted fabric for clothing described above can be applied as a legwear. The legwear may be a tubular knitted fabric such as a legging without the toe or heel. The application of the tubular knitted fabric for clothing of the present invention to a sock can favorably create a fancy style of a leg part or foot part that is important to increase the level of fashion. Particularly, not only when going out wearing an outdoor footwear, but also inside a room after removing the outdoor footwear, the high level of fashion can be displayed by continuously inserting, into a toe part or heel part knitted by the reciprocal rotation, the pattern from a region other than the toe part and the heel part.

DESCRIPTION OF THE PREFERRED EMBODIMENTS

Figure 1:
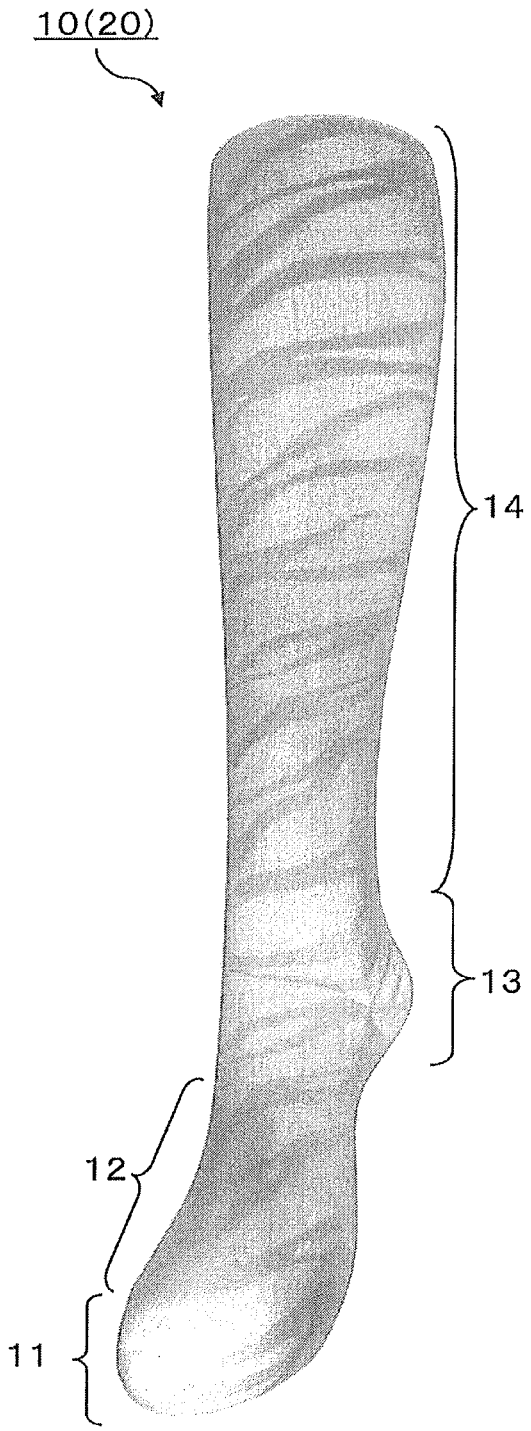
FIG. 1 is a perspective view showing a sock according to an embodiment of the present invention.

A preferred embodiment of the present invention is described hereinafter with reference to the drawings. In each of the drawings the same reference numerals are used to denote the same or equivalent parts. In the present embodiment, a legwear (a sock) using the tubular knitted fabric for clothing of the present invention is described.

A sock 10 shown in FIG. 1 has a toe part 11 covering the toes, a foot part 12 that is continued to the toe part 11 to cover the instep and arch, a heel part 13 that is continued to the foot part 12 to cover the heel, and a leg part 14 that is continued to the heel part 13 to cover the ankle and calf.

The toe part 11, the foot part 12, the heel part 13 and the leg part 14 are configured by a tubular knitted fabric for clothing 20 according to the embodiment of the present invention. The tubular knitted fabric for clothing 20 is a tubular knitted fabric knitted continuously by a circular knitting machine and has stitches of a plurality of sizes.

Figure 2:
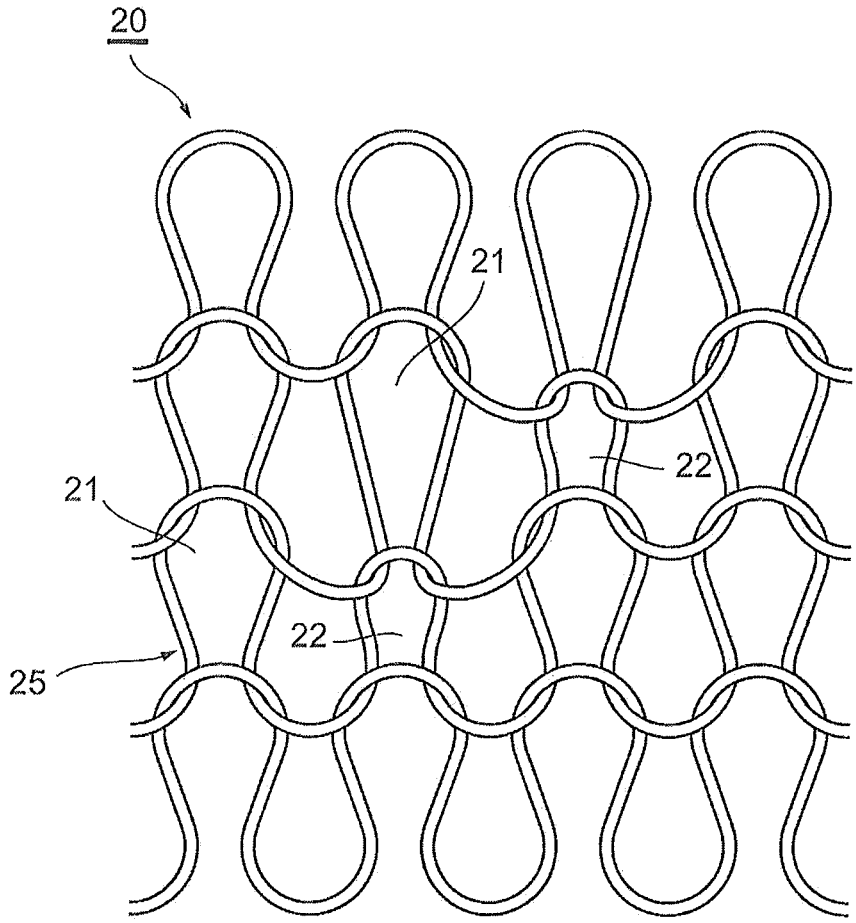
FIG. 2 is an enlarged view showing stitches of a tubular knitted fabric for clothing according to the embodiment of the present invention.

FIG. 2 is an enlarged view showing the stitches of the tubular knitted fabric for clothing according to the embodiment of the present invention. As shown in FIG. 2, the plurality of stitches configuring the tubular knitted fabric for clothing 20 have first stitches 21 and second stitches 22 having smaller stitch density (size) than the first stitches. The tubular knitted fabric for clothing of the present embodiment is configured by only these two types of stitches, the first stitches 21 and the second stitches 22. Note that, in addition to the first stitches 21 and the second stitches 22, the tubular knitted fabric for clothing 20 may have other stitches of different stitch densities.

The tubular knitted fabric for clothing 20 obtains a desired pattern formed by a circular knitting machine. This pattern is obtained by selectively disposing the smaller second stitches 22 in units of one stitch.

The circular knitting machine for knitting the tubular knitted fabric for clothing of the present invention is used for knitting a plurality of large stitches by moving a sinker in and out between reciprocating knitting needles. The second stitches 22 of the tubular knitted fabric for clothing 20 are formed when a knitting yarn is placed on the sinker as a result of selectively driving the sinker. Selectively driving the sinker controls the stitch densities of the tubular knitted fabric for clothing.

Figure 4:
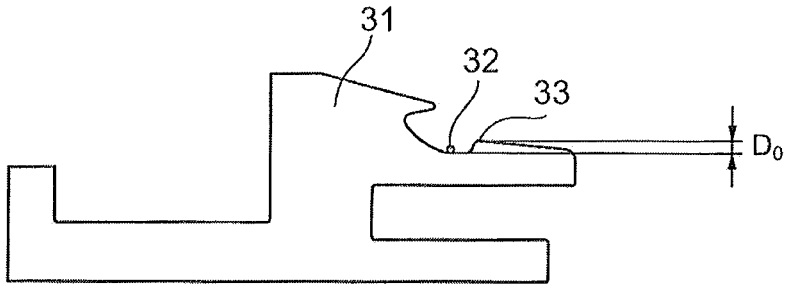
FIG. 4 is a diagram showing a difference in height of a sinker.
Figure 5:
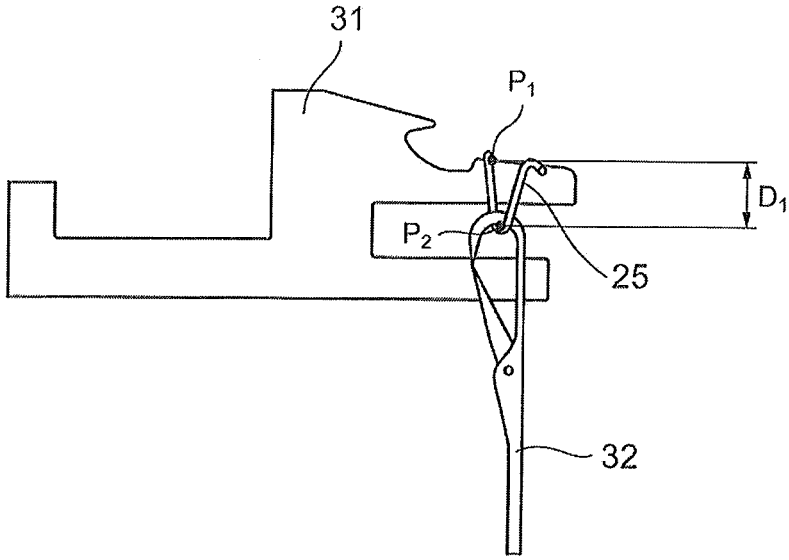
FIG. 5 is a diagram showing a positional relationship of the sinker to a knitting needle and knitting yarn, where (A) of FIG. 5 is a diagram showing a first stitch and (B) of FIG. 5 a diagram showing a second stitch.
Figure 5:
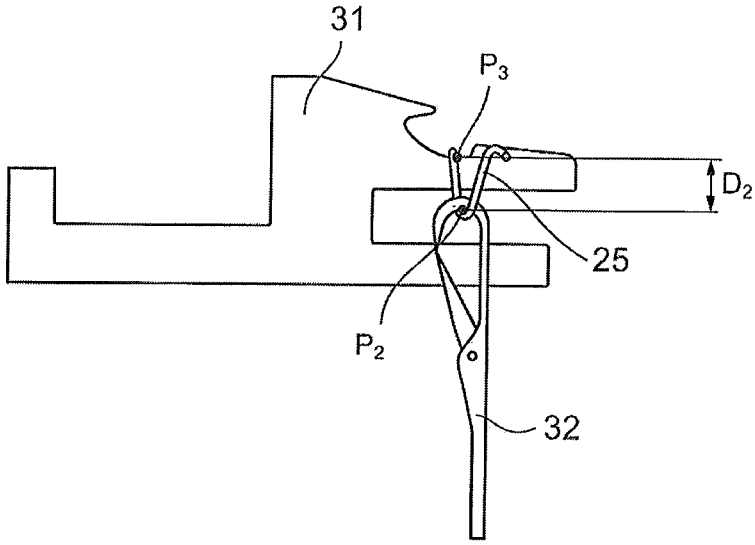

According to the control of the stitch densities performed by selectively driving the sinker, the stitch density of the first stitches 21 corresponds to a distance $D_1$ between "a contact point $P_1$ between a knitting yarn 25 and a sinker 31 (sinker top 33, see FIG. 4)" and "a contact point $P_2$ between the knitting yarn 25 and a knitting needle 32," as shown in (A) of FIG. 5. As shown in (B) of FIG. 5, the stitch density of the second stitches 22 corresponds to a distance $D_2$ between "a contact point $P_3$ between the knitting yarn 25 and the sinker 31 (a sinker dimple 32, see FIG. 4)" and "the contact point $P_2$ between the knitting yarn 25 and the knitting needle 32." In other words, by individually selecting a forward movement/backward movement of the sinker, the position on the sinker where the knitting yarn is placed can be changed, and the stitch densities can be selected in desired position for each stitch. When stitches of different stitch densities are disposed in units of one stitch, a part having smaller stitch densities than other parts becomes tight. Therefore, by disposing the knitting yarn closer to each other, the colors thereof become visually thick. Accordingly, the tubular knitted fabric for clothing obtains delicate patterns using the shading of the colors by arbitrarily disposing the stitches with the large stitch density and the stitches with the small stitch density.

The tubular knitted fabric for clothing 20 also has a positive rotation region that is knitted by a positive rotation of the cylinder of the circular knitting machine, and a reciprocal rotation region that is knitted by a reciprocal rotation of the cylinder. The pattern of the tubular knitted fabric for clothing is continuously formed astride the positive rotation region and the reciprocal rotation region. In the sock 10, the toe part 11 and the heel part 13 correspond to the reciprocal rotation region.

Figure 3:
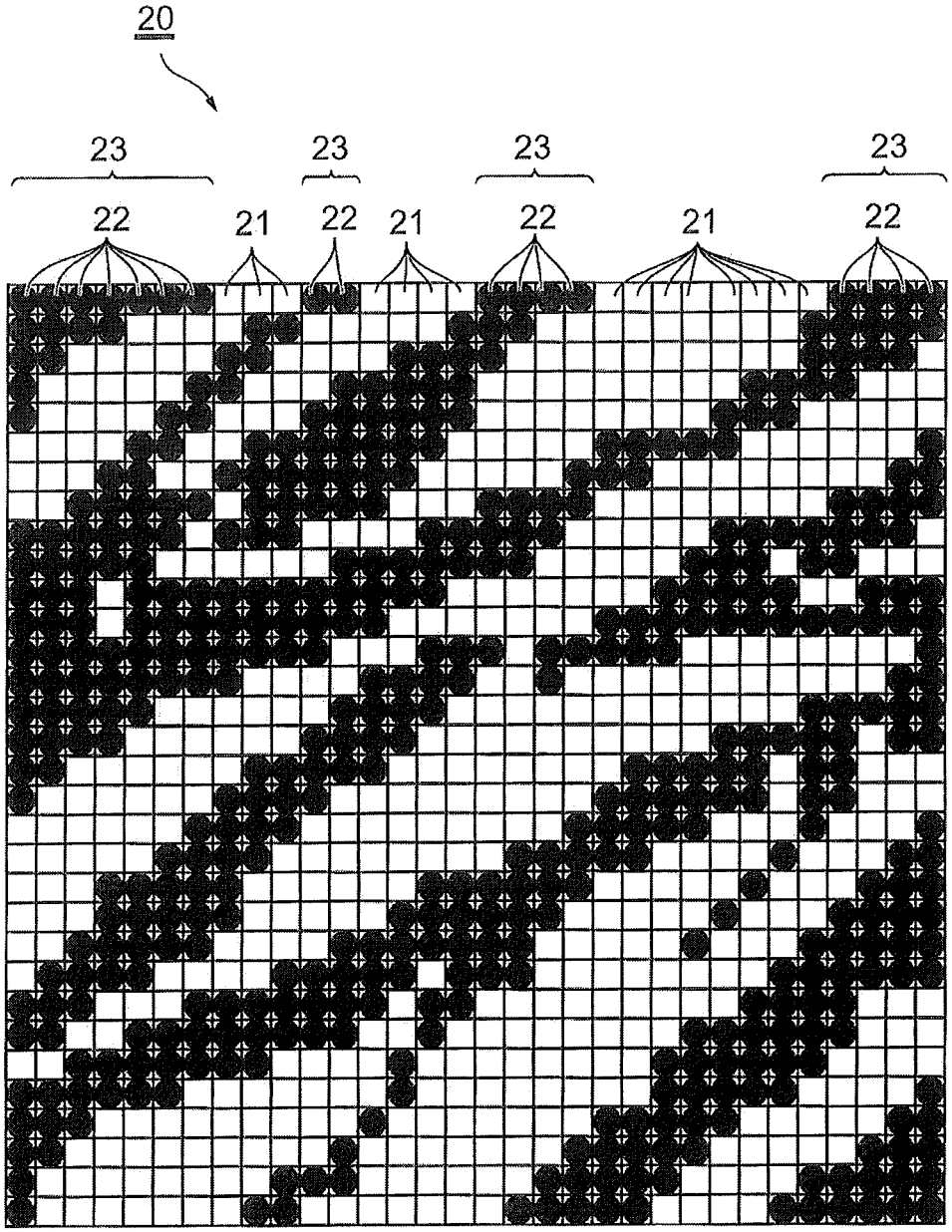
FIG. 3 is an organizational diagram showing an arrangement of the stitches of the tubular knitted fabric for clothing according to the embodiment of the present invention.

FIG. 3 is an organizational diagram showing an arrangement of the stitches of the tubular knitted fabric for clothing according to the embodiment of the present invention. As shown in FIG. 3, in the tubular knitted fabric for clothing 20, at least four small stitch bands 23 each having one or two or more of the second stitches 22 disposed within one circumferentially continuous course (in a lateral direction in FIG. 3) are formed. Accordingly, a complicated pattern can be obtained.

A single-cylinder K-type knitting machine with a 4-inch shuttle diameter and 240 needles can be used as a sock knitting machine (circular knitting machine). In the tubular knitted fabric for clothing of the present embodiment, 30D/2 woolly (textured) nylon was used as a face yarn, and 15/7-5F SCY (single covered yarn) obtained by covering 7D nylon with 15D polyurethane was used as a back yarn. As a sinker, the one with a sinker height difference of 1.0 mm was used. Under these conditions, a vivid pattern can be obtained.

The knitting machine with 240 needles was used in the present invention in order to obtain a delicate pattern with the abovementioned yarns, but the number of needles can be arbitrarily selected depending on the yarns suitable for a desired tubular knitted fabric for clothing.

The shuttle diameter is 4 inches but can be arbitrarily selected depending on the use application of the desired tubular knitted fabric for clothing.

The knitting yarns are desirably made of a somewhat elastic yarn (woolly-processed yarn) obtained by crimping synthetic fibers such as nylon or polyester. Use of a non-elastic yarn such as a cotton yarn on a fabric causes intense stretching of the stitches when a wearer wears the fabric. This cannot keep desired stitch densities, and, as a result, a vivid pattern cannot be obtained. On the other hand, use of natural fibers cannot achieve differences in shading using the stitch densities thereof.

Based on the conditions of the knitting machine described above, the level of fashion can be further increased brightening up the pattern by using a lame yarn as the knitting yarns. The yarn has a thickness of 30D/2 but may have other thickness complying with the knitting machine.

A height difference $D_0$ of the sinker 31 is the difference between the sinker top 33 and the sinker dimple 32, as shown in FIG. 4. For example, the height difference $D_0$ of the sinker 31 can be 1.0 mm, 0.8 mm, or 0.6 mm. The sinker top 33 corresponds to a part for holding the knitting yarns at a tip end part of the sinker 31. The sinker dimple 32 corresponds to a part that is depressed deeper than the sinker top 33 on the rear end side from the sinker top 33. The height difference of the sinker has an affect on the difference in stitch density. The greater the height difference of the sinker is, the greater the stitch density difference. The smaller the height difference of the sinker is, the smaller the stitch density difference. In addition, because the stitch densities are affected by the number of needles and the materials/thicknesses of the knitting yarns, the height difference of the sinker needs to be adjusted carefully by approximately at least 0.1 mm according to these conditions, in order to obtain vivid shading. For instance, when the height difference of the sinker is 1.0 mm, it is appropriate to use the 30D/2 woolly nylon as the face yarn and the SCY 15/7-5F as the back yarn. When the height difference is 0.8 mm, it is appropriate to use the 70D/2 woolly nylon as the face yarn and the SCY 20D/12-7F as the back yarn. When the height difference is 0.6 mm, it is appropriate to use 32/-cotton acryl as the face yarn and FTY 20/75 as the back yarn. A delicate, beautiful pattern can be obtained by using these height differences of the sinker and the knitting yarns. As shown in FIGS. 1 to 3, arbitrarily changing the stitch densities for each stitch by selecting the conditions described above can form different patterns (designs).

Example 1

Specifications of a tubular knitted fabric for clothing according to Example 1 are explained.

Face yarn: Woolly nylon, 60 deniers (30/2)

Back yarn: SCY 15/7-5F produced

In this tubular fabric according to Example 1, a first stitch part with a great stitch density configures a translucent fabric, and a second stitch part having a stitch density smaller than that of the first stitch part configures a non-translucent pattern. Note that the term "a first stitch part" represents a region in which the first stitches are formed, and the term "a second stitch part" represents a region in which the second stitches are formed.

This sock according to Example 1 represents a pattern continuously formed astride a region knitted by the reciprocal rotation of the cylinder (the heel part, the toe part) and a region adjacent thereto (knitted by the positive rotation of the cylinder).

The pattern represented by the tubular knitted fabric for clothing according to the embodiment of the present invention can be any patterns such as stripes obtained in Example 1, geometric designs configured by straight lines or polygons, butterflies or other detailed animal designs obtaining beauty, human faces, and characters.

The length of the sock is the length of a leg part below knee. In the present invention, the tubular knitted fabric for clothing or the socks shown in the examples can be of any length. In order to effectively express a higher level of fashion, the sock preferably has crew length or longer (the length up to a lower part of calf).

Example 2

Specifications of a tubular knitted fabric for clothing according to Example 2 are explained.

Face yarn: Lame yarn, equivalent to 40 deniers, purple

Back yarn: SCY 15/7-5F produced

In this sock according to Example 2, the first stitch part with a great stitch density configures a translucent fabric, and the second stitch part having a stitch density smaller than that of the first stitch part forms shading of the lame yarn as a pattern. When a lame yarn is used in a fabric to form a pattern by means of a conventional technology, a cut end of the yarn becomes exposed on the inside of the fabric, providing an extremely uncomfortable tingling sensation at a film part. However, use of the technology of the present invention can produce a pattern without cutting the lame yarn, eliminating such uncomfortable sensation.

Example 3

Specifications of a tubular knitted fabric for clothing according to Example 3 are explained.

Face yarn: Woolly nylon, 60 deniers (30/2), yellow

Back yarn: DCY 20/12×12, black

In this sock according to Example 3, yarns of different colors are used as the face yarn and the back yarn to represent the face yarn (yellow) in the first stitch part having a great stitch density and the back yarn (black) in the second stitch part having a small stitch density. As a result, a pattern with new texture can be realized, putting an emphasis on the pattern.

Example 4

Specifications of a tubular knitted fabric for clothing according to Example 4 are explained.

Face yarn: Lame yarn, equivalent to 40 deniers, purple

Back yarn: DCY 20/12×12, black

In addition to the effects achieved by Example 2 and 3, this sock according to Example 4 can provide a high level of fashion and comfortable feeling.

Example 5

Figure 6:
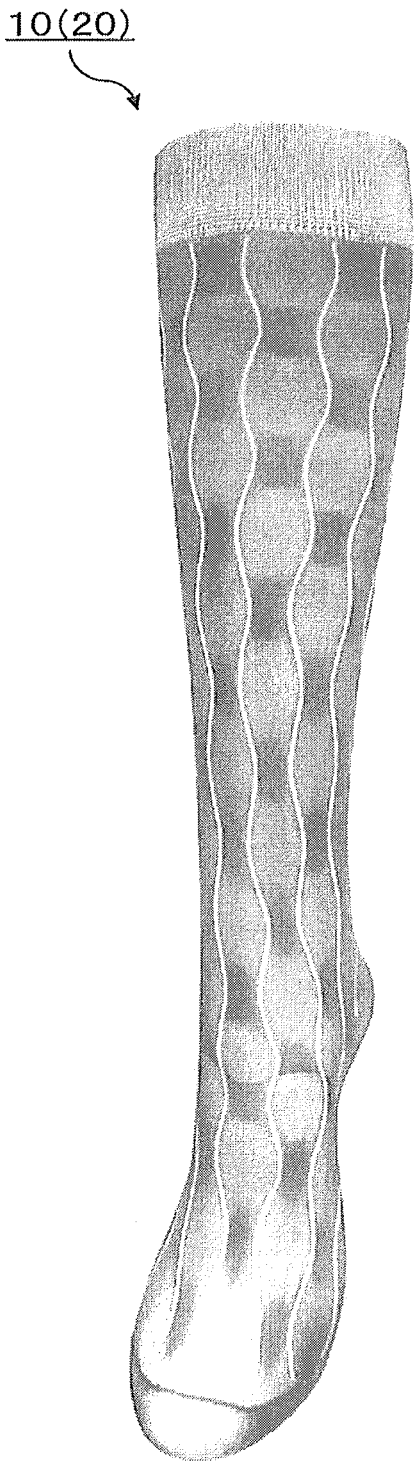
FIG. 6 is a perspective view showing a sock according to a fifth example of the present invention.

A tubular knitted fabric for clothing according to Example 5 is described. FIG. 6 is a perspective view showing a sock according to a fifth example of the present invention. A sock 10 of Example 5 is obtained by inserting a pattern configured by a different knitting method, in addition to a pattern configured by the difference in stitch density. More specifically, mesh knitting is performed linearly in a vertical direction so that the mesh knitting part forms a white line of space that is opened wider than other parts. Moreover, the first stitch part and the second stitch part are alternately provided between the mesh stitching line to obtain a wave-like pattern. By controlling the stitch densities and using a different knitting method as described above, more complicated patterns can be obtained. The different knitting method can be not only the mesh knitting method but also a tuck knitting method.

According to the tubular knitted fabric for clothing of the present embodiment, because the second stitches smaller than the first stitches are selectively disposed in units of one stitch, the shading between adjacent stitches becomes obvious, realizing a delicate, beautiful knitted pattern. This can achieve a tubular knitted fabric for clothing that represents a desired pattern by using visible shading obtained by the difference in stitch size. This can provide a tubular knitted fabric for clothing that obtains a delicate pattern on a surface of the knit garment and provide a high level of fashion and comfortable feeling.

The above has specifically described the present invention based on its embodiment, but the present invention is not limited to the embodiment. For instance, the sock 10 according to the embodiment obtains the pattern by using the shadings of the first stitches 21 and the second stitches 22, but the pattern may be obtained by, for example, a combination of technologies that are normally used (cut-boss, tuck, mesh, embroidery, sewing, etc.).

The tubular knitted fabric for clothing can be applied as a legwear to pantyhose, supporter, stocking and the like. The tubular knitted fabric for clothing can also be applied to a garment used in, for example, a body section other than a leg.

In addition, synthetic fibers such as nylon, polyester and rayon, natural fibers such as cotton, wool and hemp, or a blended yarn thereof can be used as the face yarn of the tubular knitted fabric for clothing. Elastic yarns such as SCY, DCY and FTY, or a false twisted yarn such as woolly nylon can be used as the back yarn of the tubular knitted fabric for clothing. In addition, the tubular knitted fabric for clothing can be knitted even with one of the yarns that can be used as the face yarn and the back yarn.

The tubular knitted fabric for clothing and the legwear according to the embodiment of the present invention can not only obtain a delicate pattern on a surface of the knit garment but also provide a high level of fashion and comfortable feeling. The tubular knitted fabric for clothing and the legwear according to the embodiment of the present invention can express vivid shading between adjacent stitches, as well as a beautiful knitted pattern.

What is claimed is:

1. A tubular knitted fabric for clothing that is knitted to obtain a desired pattern by a circular knitting machine capable of moving a sinker in and out between reciprocating knitting needles to knit stitches of a plurality of sizes in a same course, wherein the stitches of the plurality of sizes include a first stitch and a second stitch smaller than the first stitch, the pattern is obtained by selectively disposing the second stitch in units of one stitch, and the second stitch is formed by selectively driving the sinker to move in and out between the knitting needles, wherein each continuous course of the tubular knitted fabric for clothing includes at least four bands of second stitches each having one or two or more of the second stitches, separated by bands of first stitches.

2. The tubular knitted fabric for clothing according to claim 1, comprising:

a positive rotation region formed by knitting by a positive rotation of a cylinder of the circular knitting machine; and a reciprocal rotation region formed by knitting by a reciprocal rotation of the cylinder, wherein the pattern is obtained continuously astride the positive rotation region and the reciprocal rotation region.

3. A legwear, comprising the tubular knitted fabric for clothing according to claim 1.

* * * * *